US008636602B2

(12) United States Patent
Eling et al.

(10) Patent No.: US 8,636,602 B2
(45) Date of Patent: Jan. 28, 2014

(54) BOWLING LANE WITH MURAL IMAGE

(75) Inventors: Joy Eling, Grand Haven, MI (US); Troy Recknagel, Muskegon, MI (US); Kurt Harz, Lisle, IL (US); John Roush, Kansas City, MO (US)

(73) Assignee: Brunswick Bowling & Billiards Corporation, Lakeforest, IL (US)

( * ) Notice: Subject to any disclaimer, the term of this patent is extended or adjusted under 35 U.S.C. 154(b) by 0 days.

(21) Appl. No.: 13/507,421

(22) Filed: Jun. 27, 2012

(65) Prior Publication Data

US 2012/0270669 A1 Oct. 25, 2012

Related U.S. Application Data

(63) Continuation of application No. 12/657,866, filed on Jan. 29, 2010, now Pat. No. 8,435,128.

(60) Provisional application No. 61/206,689, filed on Feb. 3, 2009.

(51) Int. Cl.
*A63D 1/00* (2006.01)

(52) U.S. Cl.
USPC ..... 473/54; 473/115

(58) Field of Classification Search
USPC ..... 40/54, 115, 427, 442, 444, 452, 543, 40/559, 560
See application file for complete search history.

(56) References Cited

U.S. PATENT DOCUMENTS

| | | | |
|---|---|---|---|
| 4,122,237 | A | 10/1978 | Kaiserman |
| 4,339,129 | A | 7/1982 | Gautraud |
| 4,580,780 | A | 4/1986 | Gautraud |
| 4,795,152 | A | 1/1989 | Suiter |
| 4,867,816 | A | 9/1989 | Suiter |
| 4,944,514 | A | 7/1990 | Suiter |
| D359,333 | S | 6/1995 | Kang |
| 5,529,541 | A | 6/1996 | Perrier |
| RE35,778 | E | 4/1998 | Stirling et al. |
| 5,846,138 | A | 12/1998 | Borden et al. |
| 5,888,142 | A | 3/1999 | Perrier |
| 5,902,670 | A | 5/1999 | Ripstein |
| 5,924,931 | A | 7/1999 | Morrissey, III |
| 6,031,343 | A | 2/2000 | Recknagel et al. |
| 6,450,892 | B1 | 9/2002 | Burkholder et al. |
| 7,022,024 | B2 | 4/2006 | Brim et al. |
| 2005/0020368 | A1 | 1/2005 | Burkholder et al. |

(Continued)

FOREIGN PATENT DOCUMENTS

| | | |
|---|---|---|
| WO | WO 00/76605 | 12/2000 |

OTHER PUBLICATIONS

"QubicaAMF Lanes—SPL Lanes, MAD Lanes", 7 pages, 2008.
"Brunswick Lane Systems," 7 pages, 2007.

(Continued)

*Primary Examiner* — William Pierce
(74) *Attorney, Agent, or Firm* — Brinks Gilson & Lione

(57) ABSTRACT

A bowling lane with a mural image is disclosed. In one embodiment, a plurality of bowling lane panels are provided, wherein each bowling lane panel depicts a different portion of a mural image. The plurality of bowling lane panels are assembled and secured onto a surface such that the assembly of the plurality of bowling lane panels forms the mural image. In another embodiment, a bowling center is provided with at least two bowling lanes. Each bowling lane depicts a mural image, and the mural images on the various bowling lanes form a composite multi-lane mural image.

12 Claims, 12 Drawing Sheets
(9 of 12 Drawing Sheet(s) Filed in Color)

(56) References Cited

U.S. PATENT DOCUMENTS

| | | | |
|---|---|---|---|
| 2005/0037853 | A1 | 2/2005 | Brim et al. |
| 2006/0019762 | A1 | 1/2006 | Ford et al. |
| 2008/0044677 | A1 | 2/2008 | Dumond et al. |
| 2008/0268228 | A1 | 10/2008 | Dumond |

OTHER PUBLICATIONS

"Center Maintenance & Resurfacing 2008/2009 Catalog, Guardian Lane Covering," title page and p. 19, 2008.

"Guardian Image Lane Surface from Perry Austen," 2 pages, 2008.

Brunswick News Release: "Now, You Can Bowl 'Under the Seas' at Bass Pro Shops, Brunswick Bowling & Billiards first-ever joint effort," 2 pages, Aug. 20, 2009.

Extended European Search Report for Corresponding EP Application No. 10250172.3, 7 pages, Jun. 2010).

Extended European Search Report for Corresponding EP Application No. 11150306.6-2318, 8 pages, Apr. 20, 2011).

Office Action for U.S. Appl. No. 12/657,866, dated Sep. 18, 2012, 8 pages.

BOWLING LANE WITH MURAL IMAGE

CROSS-REFERENCE TO RELATED APPLICATION

The present patent application is a continuation of U.S. patent application Ser. No. 12/657,866, filed Jan. 29, 2010, now U.S. Pat. No. 8,435,128, which claims the benefit of the filing date under 35 U.S.C. §119(e) of U.S. Patent Provisional Application No. 61/206,689, filed Feb. 3, 2009, both of which are hereby incorporated by reference in its entirety.

BACKGROUND

A bowling lane is typically 60 feet long from the foul line to the pin deck. In a traditional bowling lane, 39 boards of wood are joined side-to-side in the lane. Instead of using wood, a synthetic bowling lane can be constructed from laminate panels. Current synthetic lanes are typically created to look like traditional wooden bowling lanes by depicting an image of 39 boards of wood side-to-side in the lane. In some situations, a synthetic bowling lane can contain a layer having a decorative effect, an advertisement (e.g., a corporate logo or product name), or slogan (e.g., "Strike 'Em Down"), as described in U.S. Patent Application Publication No. US 2005/0020368 to Brunswick Bowling & Billiards Corp. A bowling lane can also be treated with a fluorescent dye that is visible under black light to make the bowling lane glow in the dark, as described in U.S. Pat. No. 5,529,541, also to Brunswick Bowling & Billiards Corp.

SUMMARY

The present invention is defined by the claims, and nothing in this section should be taken as a limitation on those claims.

By way of introduction, the embodiments described below relate to a bowling lane with a mural image. In one embodiment, a plurality of bowling lane panels are provided, wherein each bowling lane panel depicts a different portion of a mural image. The plurality of bowling lane panels are assembled and secured onto a surface such that the assembly of the plurality of bowling lane panels forms the mural image. In another embodiment, a bowling center is provided with at least two bowling lanes. Each bowling lane depicts a mural image, and the mural images on the various bowling lanes form a composite multi-lane mural image. These multi-panel and/or multi-lane mural images create a continuous picture for a creative look. All or part of the mural can be viewable in white light and can be enhanced or created using ultra-violet photoluminescent inks. Other embodiments are disclosed, and each of the embodiments can be used alone or together in combination.

The embodiments will now be described with reference to the attached drawings.

BRIEF DESCRIPTION OF THE DRAWINGS

The patent or appplication file contains at least one photograph executed in color. Copies of this patent or patent application publication with color photographs will be provided by the Office upon request and payment of the necessary fee.

The patent or application file contains at least one photograph executed in color.

DETAILED DESCRIPTION OF THE PRESENTLY PREFERRED EMBODIMENTS

Introduction

The embodiments presented herein generally relate to a bowling lane with a mural image. These embodiments can be used to create a multi-panel and/or multi-lane mural that is a continuous picture for a creative look. This image can be viewable in white light and can be enhanced or created using ultra-violet photoluminescent inks. Applying these embodiments to a synthetic bowling lane would change the bowling lane into a large scale decorative mural. Each lane panel would contain a portion of the overall picture. When assembled into a bowling lane or multiple bowling lanes, the images would form much larger continuous images (e.g., a mural image that extends over 12 lanes). The inks used to create these images are preferably multi-colored inks visible in white light, although other inks can be used, such as, but not limited to, photoluminescent inks, which could also be used to create the mural visible under ultra violet lighting. Depth and shadows within the image could be created by varying the amount and placement of the photoluminescent inks, creating a look of varying intensity. In the case of photoluminescent ink, the lane may appear like a traditional lane in normal white light (while the white lights are on), and photoluminescent ink images become visible to create the multi-panel mural image when ultra violet lights are turned on.

In one embodiment, blue glow images are printing on existing glow lanes that are visible under black lighting and invisible under standard ambient lighting.

Many variations can be used with these embodiments, such as, for example:

(1) Printing multiple glow and non-glow images across multiple lane panels to create single lane murals and even multi-lane murals;

(2) Printing glow images across the lane in varying intensities (monochromatic designs); and (3) Printing glow images across laminate table tops in varying intensities.

These images could be printed using any suitable technique including, but not limited to, using silk-screens, print cylinders, or digital printing capabilities. Accordingly, any suitable apparatus and method for creating murals on one or more bowling lanes can be used.

Exemplary Bowling Lane Murals

Figure 1:
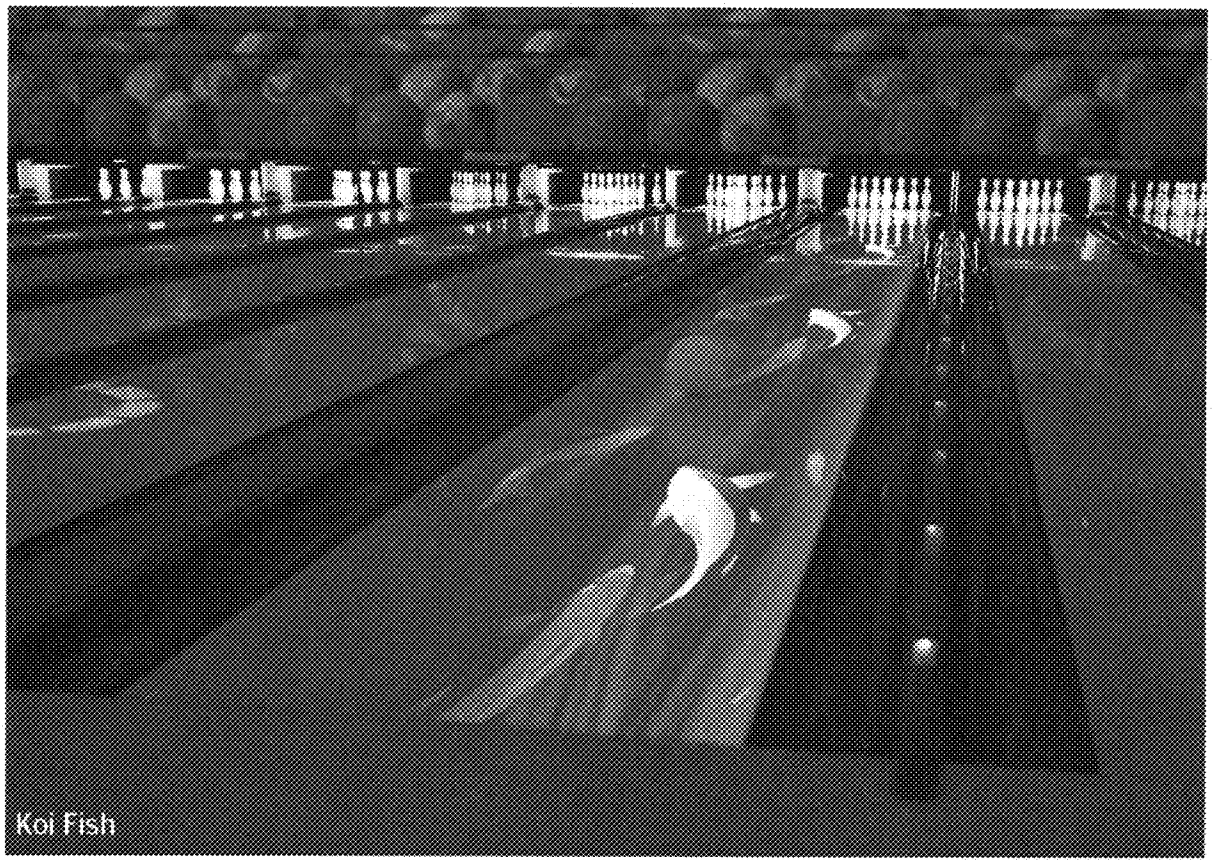
FIG. 1 is an illustration of a koi fish bowling lane mural of an embodiment.
Figure 2:
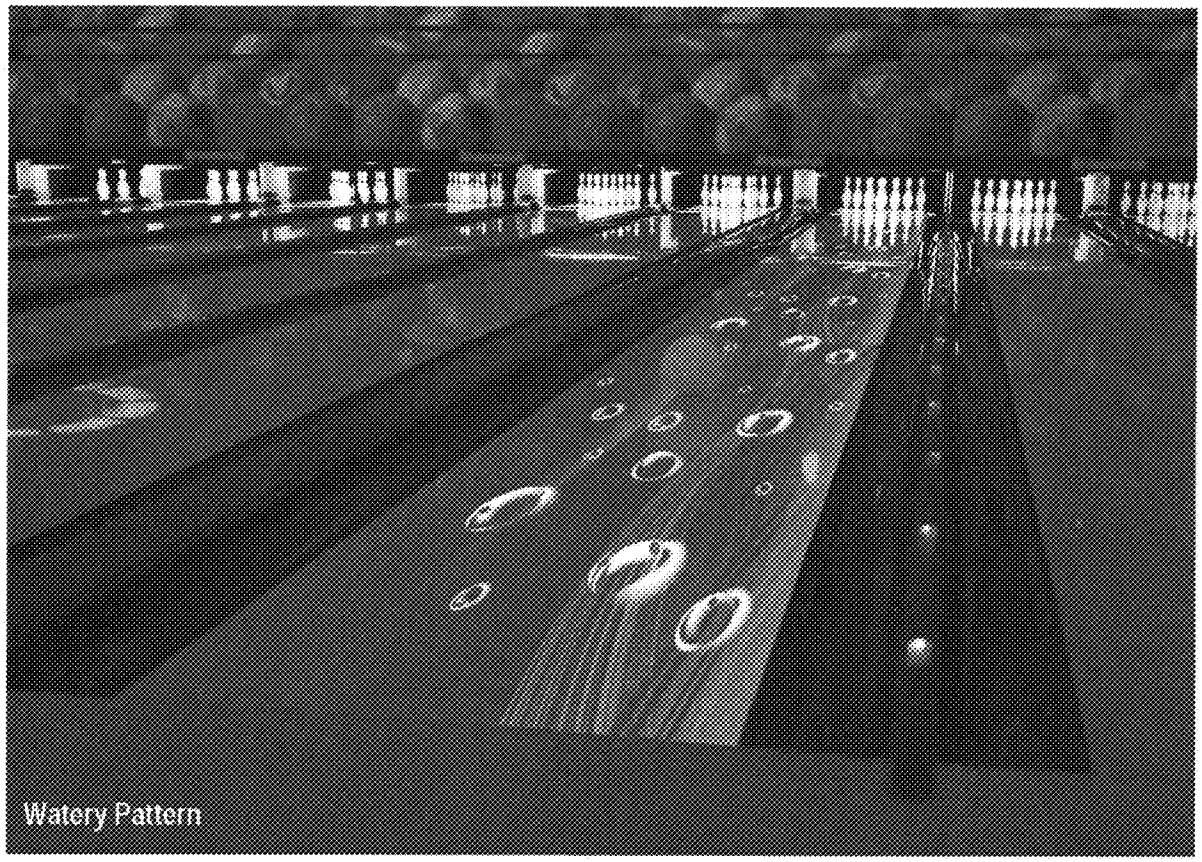
FIG. 2 is an illustration of a watery pattern bowling lane mural of an embodiment.
Figure 3:
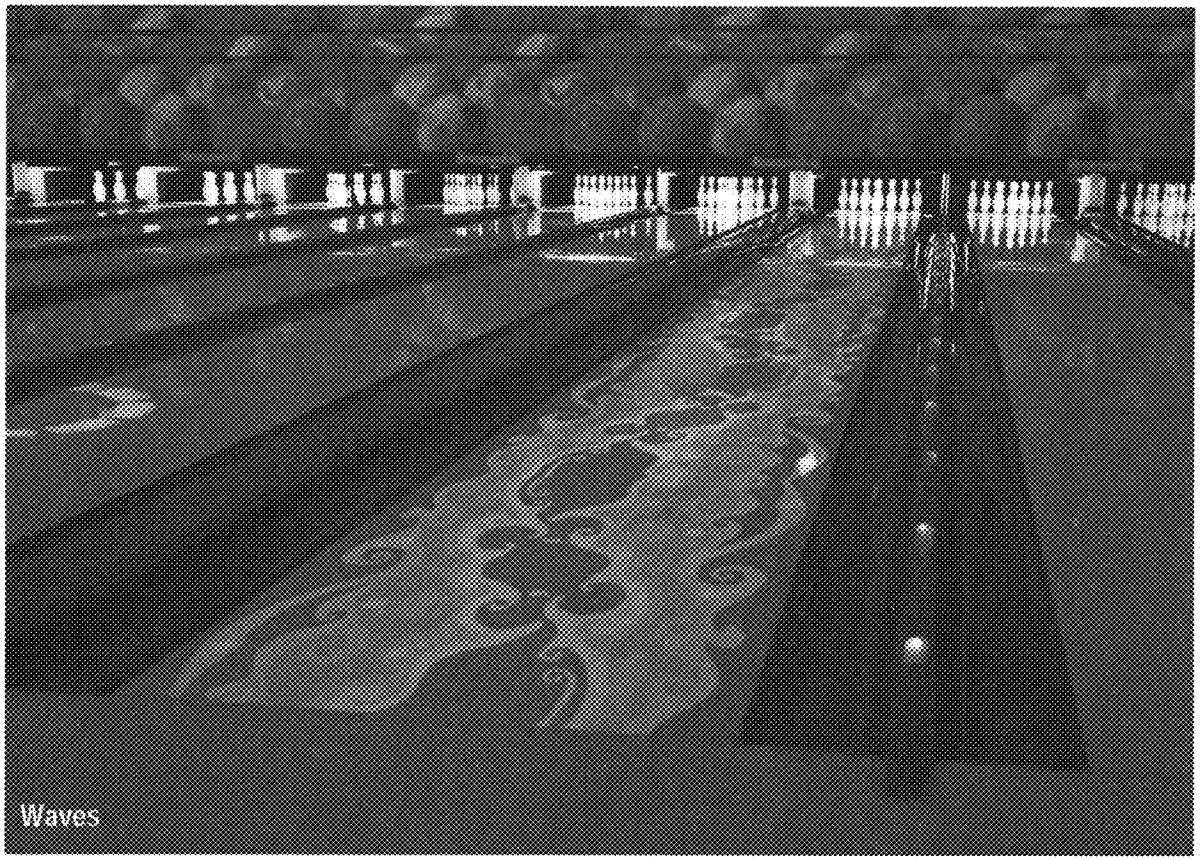
FIG. 3 is an illustration of a waves bowling lane mural of an embodiment.
Figure 4:
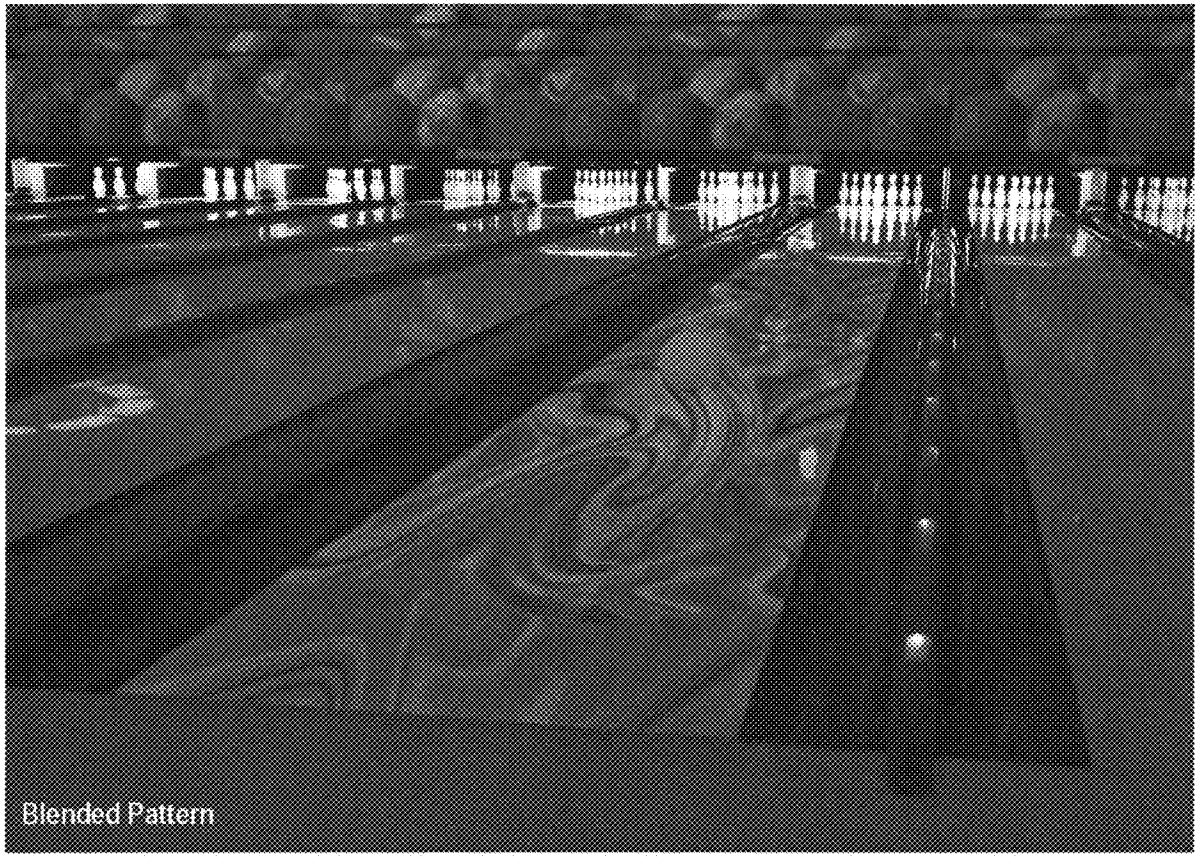
FIG. 4 is an illustration of a blended pattern bowling lane mural of an embodiment.
Figure 5:
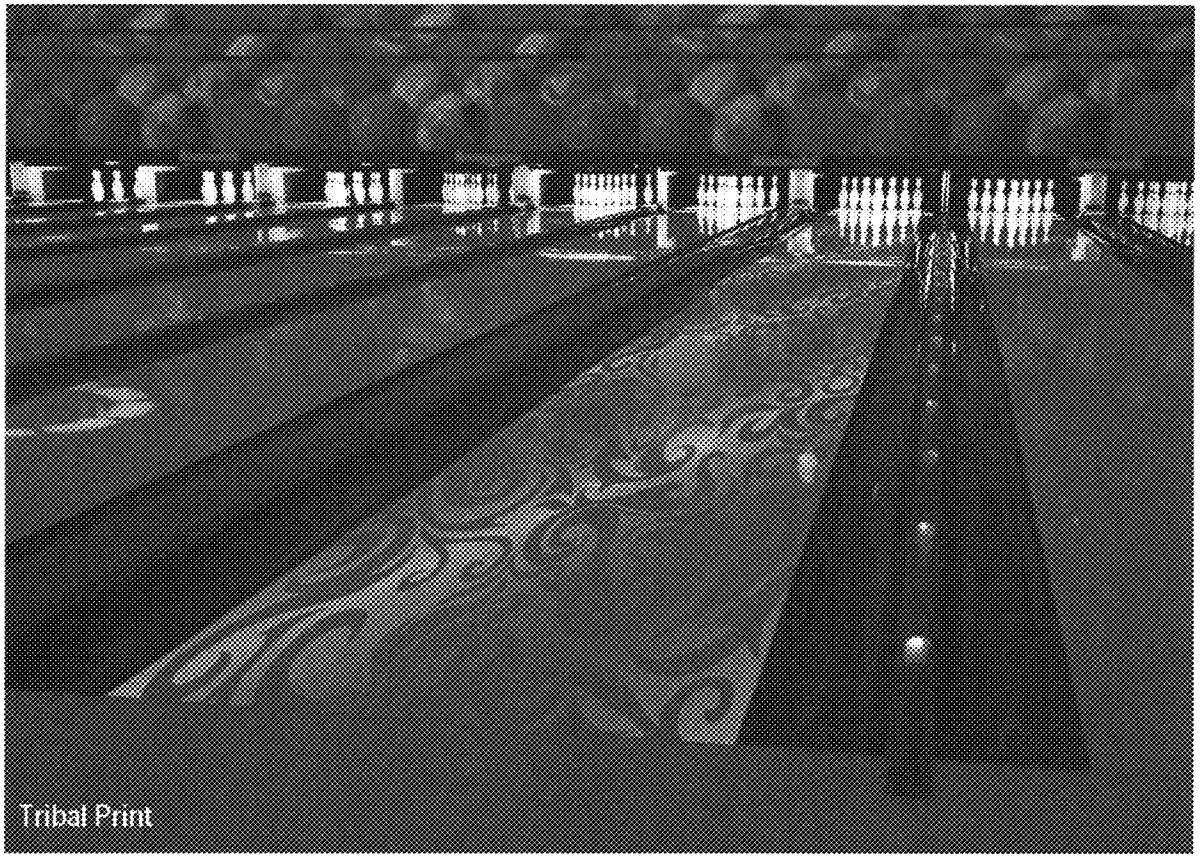
FIG. 5 is an illustration of a tribal print bowling lane mural of an embodiment.
Figure 6:
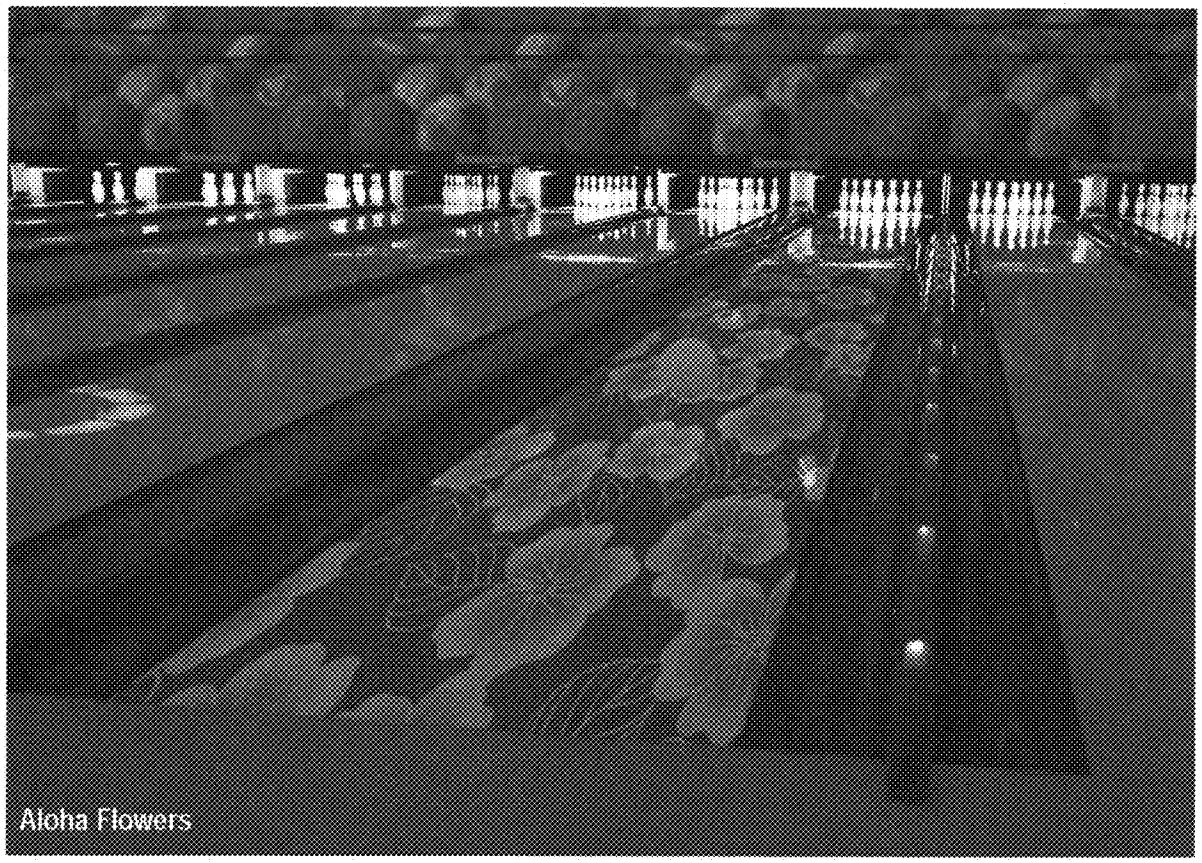
FIG. 6 is an illustration of an aloha flowers bowling lane mural of an embodiment.

As mentioned above, a mural image can take any suitable form. FIGS. 1-6 are examples of some bowling lane murals. FIG. 1 is an illustration of a koi fish bowling lane mural of an embodiment. FIG. 2 is an illustration of a watery pattern bowling lane mural of an embodiment. FIG. 3 is an illustration of a waves bowling lane mural of an embodiment. FIG. 4 is an illustration of a blended pattern bowling lane mural of an embodiment. FIG. 5 is an illustration of a tribal print bowling lane mural of an embodiment. FIG. 6 is an illustration of an aloha flowers bowling lane mural of an embodiment. Of course, these are merely examples, and other mural images can be used. It should be noted that a mural image may or may contain the traditional 39 board image along with the image depicted in the mural. Depending on the mural image, the lack of traditional bowling lane markings may be important to provide a unique visual experience. In any event, custom, themed lane markings (e.g., markings that look like fish) can be used to provide visual guides for bowlers.

As also mentioned above, any suitable type of ink can be used in the mural image. For example, some or all of the mural image can be depicted using multi-colored inks that are visible in white light. Alternatively, some or all of the mural image can be depicted using a photoluminescent ink visible under ultra-violet light. When photoluminescent inks are used, the intensity of the photoluminescent ink can be consistent throughout the mural image, or the intensity can vary across the mural image to provide depth and shadows within the image. This may find particular benefits in aquatic murals, where photoluminescent inks can make the image of the water come to life. Further, if the entire mural image is depicted using photoluminescent inks, the mural image would be visible only under ultra-violet light, while a traditional bowling lane pattern or even a second mural image depicted using multi-colored inks can be visible under white light.

Figure 7:
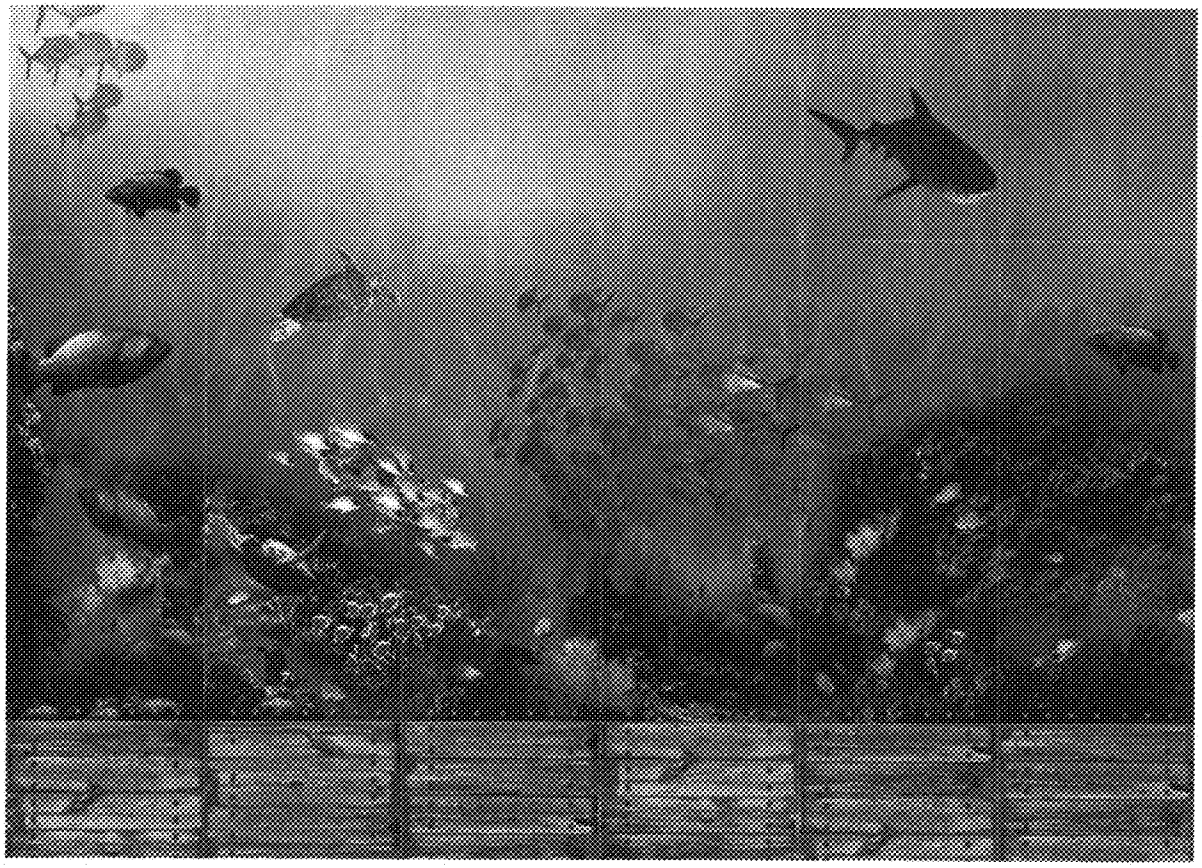
FIG. 7 is an illustration of a multi-lane mural of an embodiment.
Figure 8:
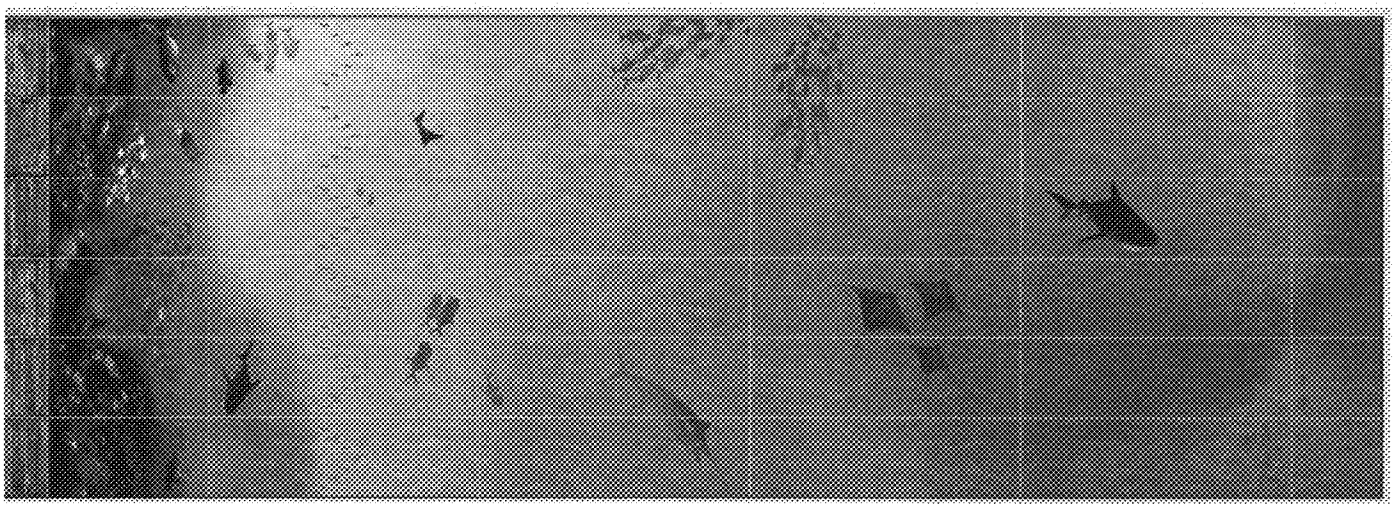
FIG. 8 is an illustration of a multi-lane mural of an embodiment.
Figure 9:
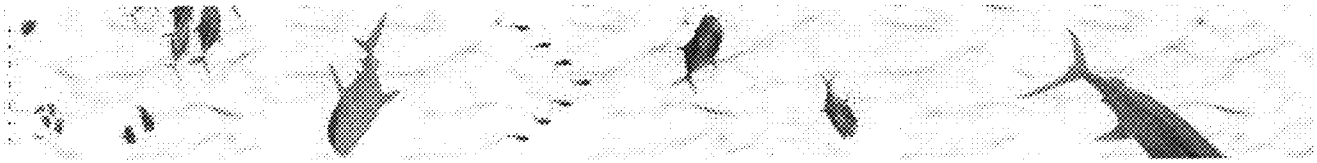
FIG. 9 is an illustration of a segment of a multi-lane mural of an embodiment.

Many alternatives are possible. For example, in FIGS. 1-6, the mural image extended entirely between the foul line and pin deck of the bowling lane. In another embodiment, the mural image extends substantially (but not entirely) between the foul line and the pin deck. In yet another embodiment, the mural image extends into the approach area adjacent to the foul line. Also, while FIGS. 1-6 show a mural image only on a single lane in a bowling center, a bowling center can have two or more bowling lanes with mural images. While the mural images on these lane can be independent from one another, in one embodiment, the mural images on the various bowling lanes form a composite multi-lane mural image when viewed together. FIGS. 7 and 8 show two examples of multi-lane (here, six lanes) mural images, and FIG. 9 shows an example of a single lane's mural image, which makes up a segment of a multi-lane mural image. In FIGS. 7-8, the multi-lane mural image depicts an aquarium scene from the foul line to the pin deck, and an image of wooden panels of a dock is provided on the approach area of each lane. Again, this is merely one example, and other multi-lane mural images can be used.

It should be noted that when the multi-lane mural images shown in FIGS. 7 and 8 are applied to bowling lanes, bowling elements (such as gutters and/or ball returns) between bowling lanes may break up the continuous appearance of the multi-lane mural image. In order to provide a more continuous appearance, these bowling lane elements can also contain a part of the multi-lane mural image or a color, design, etc. to help these elements blend into the multi-lane mural image.

Figure 10:
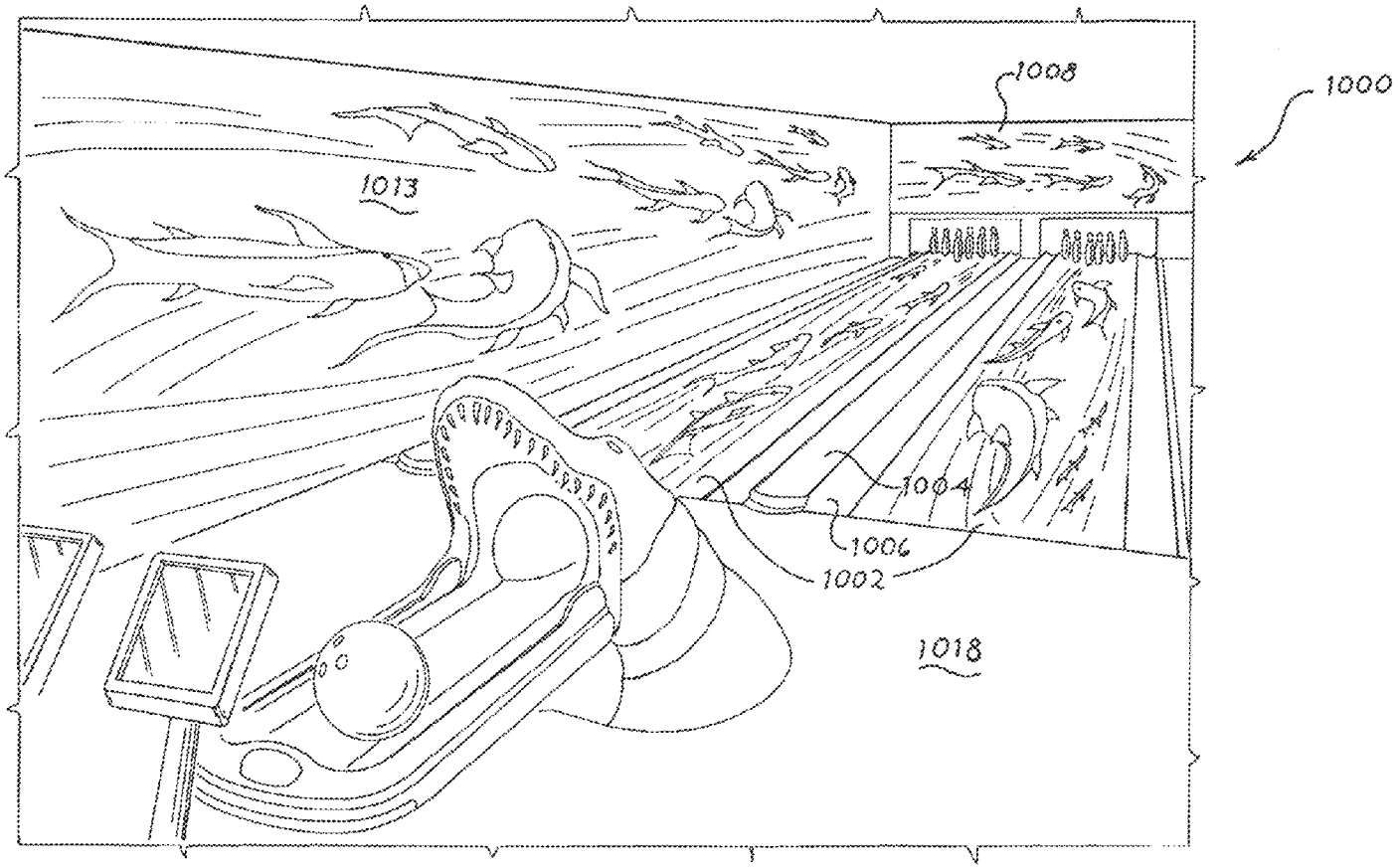
FIG. 10 is an illustration of a bowling center of an embodiment.

Also, the theme of the multi-lane mural image can be continued to other parts of the bowling center. For example, as shown in the bowling center 1000 in FIG. 10, in addition to having an aquatic multi-lane mural image extend across the plurality of bowling lanes 1002 (and, optionally, the gutter 1006 and the ball-return-path cover 1004), the side-wall 1013 of the bowling center, the approach area 1018 of the lanes, and the pinsetter mask 1008 can all contain images that are at least thematically related to, and perhaps part of, the multi-lane mural image. There can also be other elements in the bowling center that fit into the overall theme. For example, in the bowling center 1000 shown in FIG. 10, the ball return is fitted with a mold of a shark's head. Bowling center furniture, such as sofas and tables, can also be depicted in the mural's theme, using the same or different inks from those used in the multi-lane mural. For example, the bowling center 1000 can contain at least one table with an image depicted using a photoluminescent ink that is visible under ultra-violet light and whose intensity varies across the table. As another example, the bowling center 1000 can also include an island-themed bar with an aquarium of exotic fish, and the service counter for renting shoes and reserving a lane can be outfitted as a wooden ship, with fish mounts suspended from the ceiling. The bowling center 1000 can also use customized bowling balls, such as Viz-A-Ball bowling balls by Brunswick Bowling & Billiards Corp., that feature images of sharks, seagulls, bobbers, octopus, leopards, and mermaids, for example. Of course, other themes can be used. For example, if the multi-lane mural is configured as an airborne view downward over a valley, a thematically-continuous mask and/or side wall could feature side-facing views of mountains surrounding the valley; or if the lane mural is configured as a view of a tropical lagoon through a glass-bottomed boat, the lane-adjacent features may be configured with mural images of the lagoon, boat, or other features that would be thematically continuous with the lane mural.

Exemplary Construction of a Bowling Lane Mural

A mural image can be placed on a bowling lane in any suitable manner. In one embodiment, the bowling lane takes the form of a synthetic bowling lane made up of a plurality of bowling lane panels, where each bowling lane panel has printed thereon a different portion of the mural image. In one embodiment, each bowling lane panel comprises a unique portion of the mural image, so, when the bowling lane is assembled, the plurality of bowling lane panels are arranged on a surface (e.g., an existing wooden bowling lane, a bare surface, etc.) in such a way that the plurality of bowling lane panels forms the mural image. The plurality of bowling lane panels are then secured to the surface (e.g., with fasteners, such as screws or nails, with adhesive, etc.). This embodiment will be described in more detail in conjunction with FIGS. 11 and 12.

Figure 11:
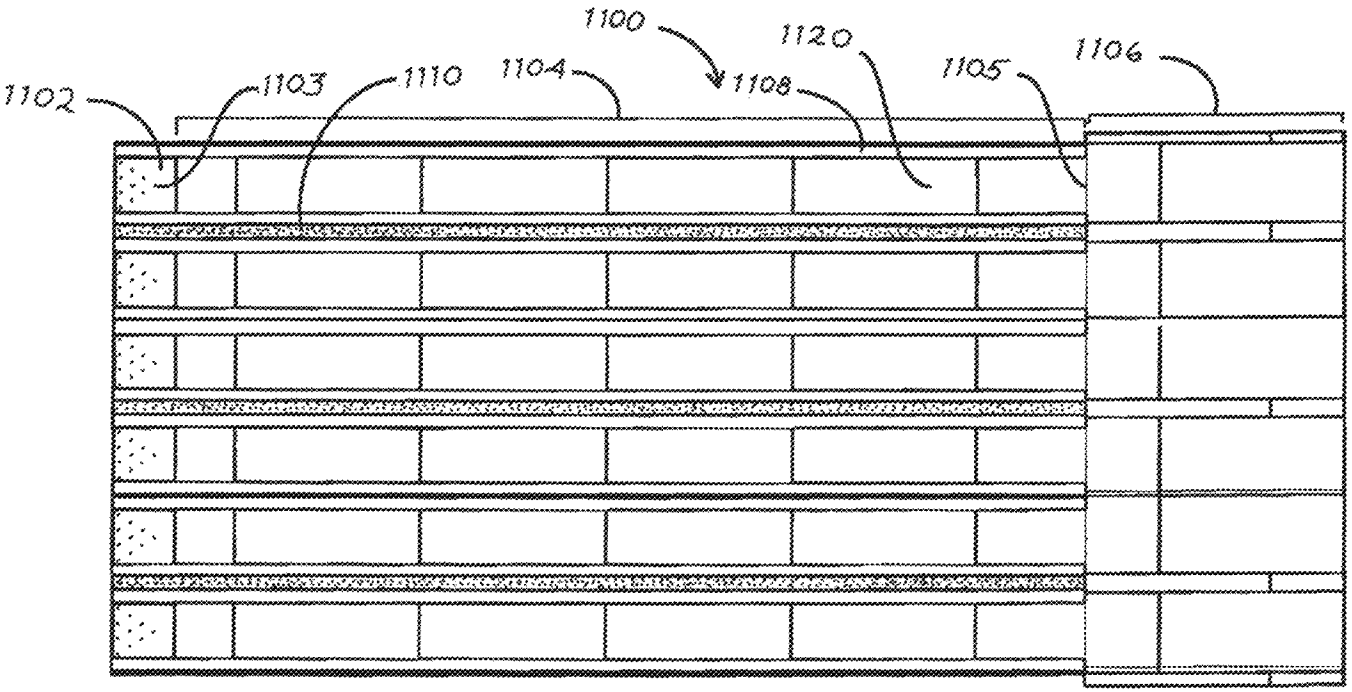
FIG. 11 is a top view of a plurality of bowling lanes of an embodiment.

FIG. 11 is a top view of a plurality of bowling lanes 1100 of an embodiment. Each lane comprises a pin deck 1102 carrying bowling pins 1103, a lane portion 1104 between the pin deck 1102 and a foul line 1105, and an approach area 1106. The lane portion 1104 is typically 41.5 inches wide and 60 feet from the foul line 1105 to the pin deck 1102, and the approach area 1106 is typically at least 15 feet long. A depressed gutter 1108 extends parallel along each side of the lane portion 1104, and a ball return path cover 1110 may be disposed between adjacent pairs of lanes and structured to house and conceal a mechanism for returning a ball to a bowler.

As mentioned above, a traditional wood surface has 39 wooden boards from side to side in the lane, but, in this embodiment, the bowling lane is made up of a plurality of synthetic bowling panels 1120, where each bowling lane panel 1120 has printed thereon a different portion of the mural image. To aid in the assembly and installation of these panels, it is preferred that each bowling lane panel 1120 be labeled with some type of identification, so that the installer will know where to position the panels.

Figure 12:
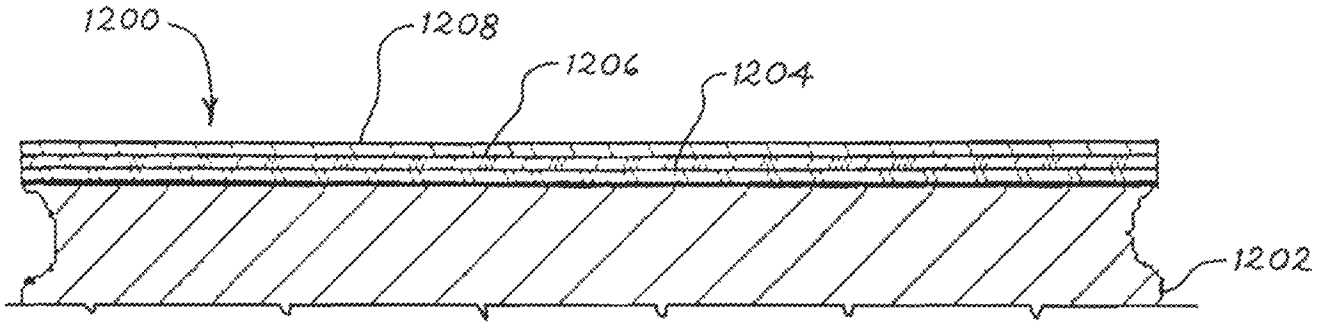
FIG. 12 is a section view of a bowling lane panel of an embodiment.

Any suitable type of bowling lane panel can be used, and FIG. 12 is a section view of a bowling lane panel 1200 of an embodiment. As shown in FIG. 12, the bowling lane panel 1200 comprises a central layer 1202 that includes a plurality of layers of phenol-formaldehyde impregnated draft paper, with the number of layers forming the layer 1202 being selected based upon the total desired thickness of the surface material 1200. The overall thickness may be from about ⅛ inch to about ⅜ inch, and may made be thicker or thinner if so desired. A print layer 1204 may be disposed on the central layer 1202. In one embodiment, the print layer may be constructed using 50# melamine formaldehyde impregnated alpha-cellulose paper or untreated alpha-cellulose paper, upon which a desired image may be printed. For example, the image may be configured as a wood grain appearance. The paper may be applied to provide a cured thickness of about 6 to about 8 mil.

In this embodiment, a first clear overlayer 1206 is disposed over the print layer 1204. The first clear overlayer 1206 may be constructed of aluminum oxide-impregnated, melamine formaldehyde impregnated alpha-cellulose paper applied at a cured thickness of about 4 to about 5 mil per layer, where a plurality of layers may be added to increase the wear resistance. The number of layers 1206 may also be adjusted depending upon the desired appearance of the printed layer 1204. A second clear overlayer 1208 may be disposed over the first overlayer 1206. The second overlayer 1208 may be constructed of low-wear (non-aluminum oxide-impregnated) melamine formaldehyde impregnated alpha-cellulose paper applied at a cured thickness of about 4 to about 5 mil per layer. Surface materials may also include those disclosed in U.S. Pat. Nos. 4,795,152, 4,867,816, 4,944,514, RE35,778, 6,450,892, each of which in incorporated herein by reference. More information about a suitable panel construction can be found in U.S. Patent Application Publication No. US 2005/0020368, which is hereby incorporation by reference.

The print layer 1204 contains the mural image and may be printed using silk screening techniques used to apply inks that are compatible with the print layer material and overlayer material. Alternatively, or in addition, the print layer 104 may be printed using dot printing, laser printing, or any other appropriate printing technique or technology. As mentioned above, the mural image can contain multi-colored inks that are visible in white light and/or photoluminescent inks that are visible under ultra-violet light. As also mentioned above, when photoluminescent inks are used, different intensities of ink can be used to vary glow intensity to provide glow accents to features of the mural. Various combinations of white light ink and ultra-violet light inks can be used to form different mural portions (e.g., (i) portions that are visible under white light, but not under ultra-violet light, (ii) portions that are visible under ultra-violet light, but not under white light, and/or (iii) portions that are visible under both ultra-violet light and under white light. For murals with portions that are visible under both ultra-violet light under white light, the ultra-violet light and ultra-violet-luminescent inks may be used to accent the white-light visible images. U.S. Pat. Nos. 5,888,142 and 5,924,931, each of which in incorporated herein by reference, describe the use of photoluminescent inks that can be used in these embodiments.

Because the mural image can be printed onto a bowling lane panel, the mural image can be user-customized (e.g., by a bowling center operator or a designer). In operation, the bowling lane panel manufacturer would receive a user request for a mural image. At this stage, the mural image can take the form of a computer file (e.g., a jpeg image) of desired artwork. Portions of the mural image would then be configured for placement onto a plurality of bowling lane panels, and the portions would then be printed onto respective bowling lane panels. As mentioned above, some type of identification (e.g., "1 of 6") can be placed onto each bowling lane panel to later assist in the proper assembly of those panels to form a mural image. This process can also include the printing (or silk screening, hot stamping, etc.) of a separate adhesive material to be placed over gutters, ball returns, etc. to continue the mural image itself or the theme of the mural image across bowling center element other than bowling lane panels. Such adhesive material can be similar to synthetic lane surfaces that are rolled onto existing bowling lanes. Such materials are typically imprinted with a natural-looking wood lane on one side and have a pressure-sensitive adhesive on the other side. Also, instead of or in addition to using a lane covering to cover gutters, ball returns, etc., a mural image can be printed onto a lane covering and applied over an existing bowling lane, instead of printing the mural image onto individual bowling lane panels.

Conclusion

It is intended that the foregoing detailed description be understood as an illustration of selected forms that the invention can take and not as a definition of the invention. It is only the following claims, including all equivalents, that are intended to define the scope of this invention. Finally, it should be noted that any aspect of any of the preferred embodiments described herein can be used alone or in combination with one another.

What is claimed is:

1. A bowling center comprising:

a first bowling lane comprising:

a first surface; and a first plurality of bowling lane panels secured to the first surface; and a second bowling lane comprising:

a second surface; and a second plurality of bowling lane panels secured to the second surface;

wherein the assembly of the first and second plurality of bowling lane panels forms a a singular, composite multi-lane mural image, wherein each bowling lane panel's position in the assembly is determined by where its unique portion is located in the singular, composite multi-lane mural image, and wherein each bowling lane panel can only be positioned in one location to still form the singular, composite multi-lane mural image.

2. The bowling center of claim 1 further comprising at least one additional bowling lane, wherein each of the at least one additional bowling lane comprises a respective plurality of bowling lane panels that each depict a different portion of a respective at least one additional mural image, and wherein the first, second, and the at least one additional mural image form the singular, composite multi-lane mural image.

3. The bowling center of claim 1 further comprising a ball return between the first and second bowling lanes, wherein the ball return comprises a mural image that, along with the first and second mural images from the first and second bowling lanes, form the singular, composite multi-lane mural image.

4. The bowling center of claim 1 further comprising at least one table comprising an image comprising a photoluminescent ink visible under ultra-violet light, wherein an intensity of the photoluminescent ink varies across the table.

5. The bowling center of claim 1, wherein the singular, composite multi-lane mural image is provided by a customer and is manufactured onto the first and second plurality of bowling lane panels.

6. The bowling center of claim 1, wherein at least part of the singular, composite multi-lane mural image comprises multi-colored inks visible in white light.

7. The bowling center of claim 1, wherein at least part of the singular, composite multi-lane mural image comprises a photoluminescent ink visible under ultra-violet light.

8. The bowling center of claim 7, wherein an intensity of the photoluminescent ink varies across the singular, composite multi-lane mural image.

9. The bowling center of claim 7, wherein the singular, composite multi-lane mural image comprises a photoluminescent ink mainly visible under ultra-violet light, wherein the singular, composite multi-lane mural image is only visible under ultra-violet light.

10. The bowling center of claim 1, wherein the plurality of first and second plurality of bowling lane panels form two singular, composite multi-lane mural images, one visible under white light and the other visible under ultra-violet light.

11. The bowling center of claim 1, wherein the first and second plurality of bowling lane panels define first and second foul lines and first and second pin decks, respectively, and wherein the singular, composite multi-lane mural images extends substantially between the first and second foul lines and the first and second pin decks, respectively.

12. The bowling center of claim 11, wherein the first and second plurality of bowling lane panels further define first and second approach areas, respectively, and wherein the singular, composite multi-lane mural images extends to the first and second approach areas, respectively.

* * * * *

UNITED STATES PATENT AND TRADEMARK OFFICE

CERTIFICATE OF CORRECTION

PATENT NO. : 8,636,602 B2
APPLICATION NO. : 13/507421
DATED : January 28, 2014
INVENTOR(S) : Joy Eling et al.

It is certified that error appears in the above-identified patent and that said Letters Patent is hereby corrected as shown below:

In the Claims

In column 6, claim 1, line 44, after "bowling lane panels forms" delete "a" (second occurrence).

Signed and Sealed this
Sixth Day of May, 2014

Michelle K. Lee

Michelle K. Lee
*Deputy Director of the United States Patent and Trademark Office*